US005226612A

United States Patent [19]

Mülfarth

[11] Patent Number: 5,226,612

[45] Date of Patent: Jul. 13, 1993

[54] APPARATUS FOR WINDING WEBS OR MATERIAL

[76] Inventor: Werner Mülfarth, Fauslerstrasse 35, 7312 Kirchheim-Teck 7, Fed. Rep. of Germany

[21] Appl. No.: 834,087

[22] Filed: Feb. 12, 1992

[30] Foreign Application Priority Data

Feb. 15, 1991 [DE] Fed. Rep. of Germany ..... 4104635

[51] Int. Cl.[5] ..... B65H 75/32; B65H 75/34

[52] U.S. Cl. ..... 242/64; 242/56 A

[58] Field of Search ..... 242/56 A, 65, 66, 64, 242/56 R

[56] References Cited

U.S. PATENT DOCUMENTS

| | | | |
|---|---|---|---|
| 3,472,462 | 10/1969 | Young | 242/64 |
| 3,784,122 | 1/1974 | Kataoka | 242/56 A |
| 3,848,824 | 11/1974 | Van Schijndel | 242/56 A |
| 3,918,654 | 11/1975 | Okubo et al. | 242/66 |
| 4,049,212 | 9/1977 | Yamaguchi et al. | 242/65 |
| 4,153,215 | 5/1979 | Schulze | 242/56 A |
| 4,345,722 | 8/1982 | Kuhn | 242/56 R |
| 4,529,141 | 7/1985 | McClenathan | 242/56 A |
| 4,715,552 | 12/1987 | Matsumoto | 242/56 A |
| 4,775,111 | 10/1988 | Kalin | 242/65 |
| 5,150,848 | 9/1992 | Consani | 242/66 |

*Primary Examiner*—Thomas B. Will

*Attorney, Agent, or Firm*—Browdy and Neimark

[57] ABSTRACT

The invention provides an apparatus for winding web-like or strip-like material such as paper, foil, film, textiles and the like. The apparatus comprises rotatably mounted and motor driven winding spindles, which are individually able to be moved along and located along a guide track, one respective full winding spindle being moved out of the winding position thereof after the winding operation and an empty winding spindle then being moved into this winding position substantially simultaneously. For changing the winding spindles in the winding position with a continuous supply of the material a first applying roll is brought into engagement on the wound material on the winding spindle located in the winding position and a second applying roll is moved into engagement with the wound material on the winding spindle moving out of the winding position. The applying rolls are mounted on essentially vertical pivot arms. Ends of the pivot arms remote from the applying rolls are arranged pivotally on at least one horizontally movable holding part. A control or automatic control device is provided for adjustment of the essentially vertical setting of the pivot arms by horizontal sliding of the at least one holding part. This ensures that on the one hand there is a simple construction and on the one hand a substantially mass-neutralized position of the applying rolls.

13 Claims, 4 Drawing Sheets

APPARATUS FOR WINDING WEBS OR MATERIAL

BACKGROUND OF THE INVENTION

The invention relates to an apparatus for rolling up web-like or strip-like material such as paper, foil, film, textiles and the like, and more particularly but not exclusively to such an apparatus comprising rotatably mounted and motor driven winding spindles, which are individually able to be moved and located along a guide track, one respective full winding spindle being moved out of the winding position thereof after the winding operation and an empty winding spindle then being moved into this winding position substantially simultaneously. For changing the winding spindles in the winding position with a continuous supply of the material a first applying roll is brought into engagement on the wound material on the winding spindle located in the winding position and a second applying roll is moved into engagement with the wound material on the winding spindle moving out of the winding position, the applying rolls being mounted on essentially vertical pivot arms.

Such an apparatus is described in the article in the periodical "Papier+Kunststoff-Verarbeiter" No. Feb. 1985, entitled "Non-stop Wickler mit Zentralantrieb", in which case the first applying roll is suspended on pivot arms with the provision of a stationary pivot bearing. The second applying roll is mounted atop pivot arms with a provision for vertically moving the pivot bearing.

The engagement forces of the applying rolls on the wound material are of decisive importance for the quality of winding and for minimizing waste. The loading pressing or force of the applying roll on the wound material primarily influences the density of winding, that is to say the hardness of a winding. It is more particularly in the case of very thin films that the surface is not completely flat and there are differences in thickness. During winding such differences in thickness have a cumulative effect so that bulges are created. In such a case the applying roll will only be in engagement with the crests of the bulges or thicker parts so that high pressing forces would here cause very high contact forces which may well lead to the entire winding having to be rejected. Although the applying roll with a length of several meters may be up to 300 kg in weight, the pressing force on the wound material should only amount to around 10N. This means that the applying rolls should be in engagement with the respective windings in such a way that their mass is neutralized and during the winding operation as well and the changing of the finished roll engagement should be maintained with a neutralization of mass effects. Even a small pivoting of the pivot arms of the applying rolls of a few degrees will lead to very large pressing forces owing to the relevant masses.

In the case of the circular winder illustrated in FIG. 5 of the above mentioned article such a mass compensated manipulation of the applying rolls is not possible. During the winding operation the first, upper applying roll is deflected more and more owing to the increase in size of the winding or coil, since the pivot bearing is stationary. The ever increasing deflection gives rise to higher and higher engagement forces on the coil. Furthermore the lower, second applying roll is urged more and more powerfully downwards during the clearance of the completed coil so that its pressing force will become larger and larger. In the case of known circular winders suitable weight reducing means for compensation are therefore necessary for such applying forces, which are very complex and involved, since the diameter and the engagement angle are constantly changing.

SHORT SUMMARY OF THE INVENTION

Accordingly one object of the present invention is to provide an apparatus of the type initially mentioned in the case of which the engagement rolls are such that their mass is neutralized even to allow for changes in the setting and the diameter of the wound winding spindles so that it is possible to ensure small and substantially constant pressing forces.

In order to achieve these and/or other objects appearing from the present specification, claims and drawings, in the present invention, ends of the pivot arms remote from the applying rolls are arranged pivotally on at least one horizontally movable holding part and a control or automatic control device is provided for adjustment of the essentially vertical setting of the pivot arms by horizontal sliding of the at least one holding part.

Owing to the horizontal sliding of the at least one holding part, it is possible for the pivot arms of the first applying roll to be held constantly in the vertical setting during the winding operation, even as the coil increases in size, by moving away the holding part so that the mass of the applying roll is neutralized. Owing to the control and/or automatic control device it is even possible to set a slight departure from the exactly vertical setting which ensures a constant pressing force. It is naturally also possible to produce the pressing force by other means such as for instance spring or resetting members acting on the pivot arms or the pivot joints. In any event it is possible for the desired low, constant pressing force to be achieved with simple means despite the great mass of the applying roll. This also goes for the changing of the winding spindle in the position of winding.

The claims define further possible embodiments of the invention.

It is preferred for the two applying rolls to be suspended from the at least one holding part, since this means that there is an automatic reset into the exactly vertical position. It is also possible in principle for the second applying roll, for instance, to be upright.

An optimum neutral mass suspension or neutral mass holding means is possible if the pivot arms of the two applying rolls are arranged on two holding parts moving mutually independently in a horizontal direction. This means that the pivot arms of these two rolls are able to be independently held in a substantially vertical setting.

In the case of a simpler embodiment of the invention it is possible for the pivot arms of both applying rolls to be jointly mounted on a horizontally moving holding part, in which respect the pivot arms may be pivoted about a common axis. Owing to a moving holding part a simple actuating drive and a respective control are possible. Since preferably the pivot arms of the first applying roll are always set in the essentially vertical position, it is necessary for the pivot arms of the second applying roll to be moved pivotally a small amount during movement away from the finished, completed coil on the winding spindle out of the winding position, such pivot movement however being smaller than the movement in the prior art device. In the case of a common holding part for both applying rolls as well it is possible for the transfer of the fully wound spindle from the first applying roll to the second one to take place in such a manner that the same vertical position is maintained.

In order in the case of continuously supplied material to terminate the winding operation when the winding spindle is full and to commence a winding operation on a newly supplied winding spindle, a doffing device for the material to be wound is arranged in a known manner permanetly between the applying rolls or may be moved in between them.

The holding part adapted to be moved is, in accordance with a practical embodiment of the invention, in the form of a motor-driven carriage or slide.

The apparatus in accordance with the invention is more particularly suitable for circular winders but however it is as well able to be used in cascade winders.

Further advantageous developments and convenient forms of the invention will be gathered from the following detailed account of two embodiments thereof in conjunction with the accompanying drawings.

LIST OF THE SEVERAL VIEWS OF THE FIGURES

DETAILED ACCOUNT OF WORKING EMBODIMENTS OF THE INVENTION.

Figure 1:
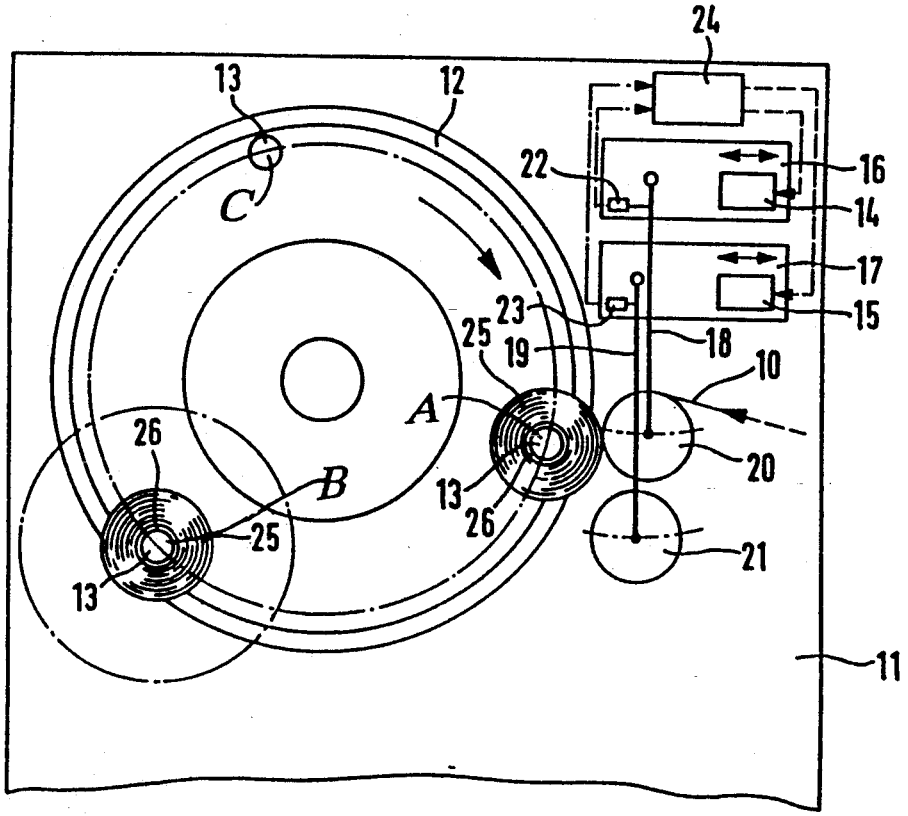
FIG. 1 is a diagrammatic side elevation of a circular winder as a first embodiment of the invention with two holding parts able to be moved independently from each other horizontally for the two applying rolls during the winding operation on a winding spindle in the winding position.
Figure 2:
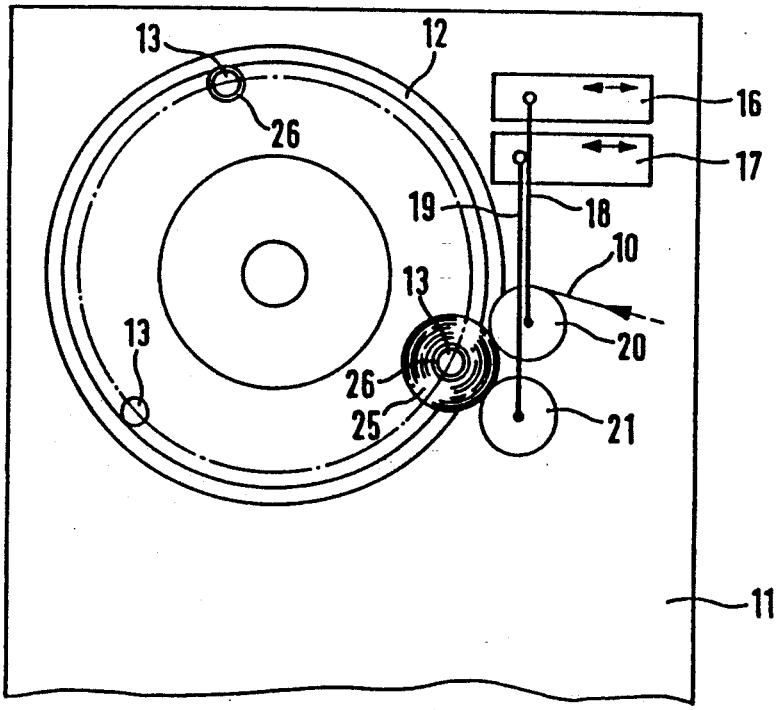
FIG. 2 shows the same arrangement as in FIG. 1 during the doffing of the complete coil or winding on the winding spindle and during the transfer from the first applying roll to the second one.
Figure 3:
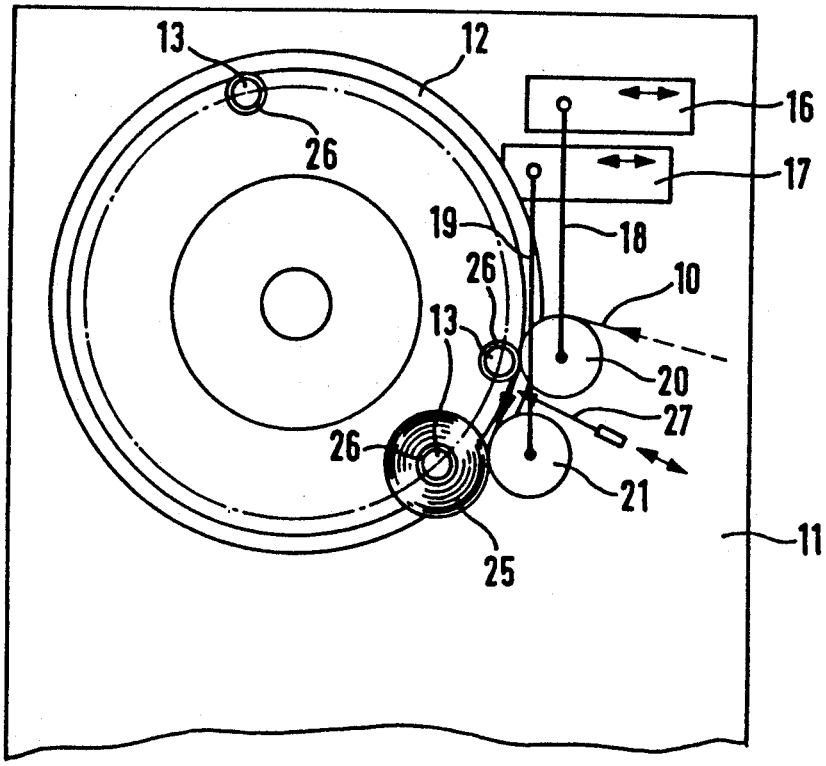
FIG. 3 shows the first embodiment of the invention in a further working position thereof.

The first embodiment of the invention illustrated in FIG. 1 and in a simplified view in FIGS. 2 and 3 takes the form of a so-called circular winder for web-like or strip-like material, such as paper, films, foils or textiles or the like. In the following account for simplification it is assumed that there is only one foil web 10. On a machine frame 11 an annular, drum-like guide track 12 is arranged, on which winding spindles may be moved independently of each other on sliding bearings, not illustrated, in the clockwise direction by a motor. Such operation may be by providing the winding spindles 13 with suitable drive motors or the drum-like guide track 12 may be arranged to be turned by a motor and the winding spindles 13 may be turned as well by coupling them up or may be caused to remain in their respective positions by uncoupling, as is described in the German patent publication 3,736,395 A in more detail. On two carriages 16 and 17, which are able to be moved on the machine frame 11 by drive motors 14 and 15 pivot arms 18 and 19 are pivotally mounted, on whose lower ends a first applying roll 20 and a second applying roll 21 are arranged. These applying rolls 20 and 21 may in the case of large winding equipment have a length of several meters and a weight of several hundred kilograms. They are naturally held at their two ends by such a pivot arm, although this is not illustrated in the figure. In the illustrated position, that is to say in the same horizontal setting of the carriages 16 and 17 the applying rolls 20 and 21 are in substantially superposed relationship.

The angle of the pivot arms 18 and 19 is detected by angle sensors 22 and 23, whose output signals pass to an electronic automatic controlling device 24. By means of it the vertical position of the carriages 16 and 17 and therefore of the applying rolls 20 and 21 is so set by operation of the drive motors 14 and 15 that the applying rolls 20 and 21 are suspended with a neutralization of their masses on the essentially vertically placed pivot arms 20 and 21. In the case of engagement of the applying rolls 20 and 21 on a partly wound or completely wound film coil 25 it is then possible by adjustment through a small predetermined of a few degrees to reproducibly set the engagement force of the respective applying roll In the case of a further possible arrangement setting members or error correcting elements serve to set this pressing force with the pivot arms in the exactly vertical setting.

The working position illustrated in FIG. 1 represents the winding operation. The winding spindle 13 located in the winding position A bears a winding core 26, on which the web 10 of film is wound up as a film coil 25 for winding. During this operation the first applying roll bears against the film 25 coil in the course of formation, the film web 10 firstly passes over the first applying roll 20 and then onto the film coil 25. The supply of the film web 10 is from a supply roll, not illustrated. In the doffing position B the reader will see a completed film coil or roll 25, which is waiting to be doffed. The large circle shown in broken lines around this roll of film indicates that it is also possible to wind coils 25 of film with a larger diameter. Lastly, a further, third winding spindle 13 is located in the supply position C, in which a new winding core 26 is placed in position.

When the film coil 25 has almost attained its desired diameter, it is moved in the clockwise direction to the doffing position B. In FIG. 2 the reader will see that at the start of this movement the coil 25 has moved a small amount in the clockwise direction so that it now comes into contact with the second applying roll 21. For this purpose both carriages 16 and 17 are moved to the left with the circular movement of the film winding 25. In the doffing position B the previously wound film winding 25 will have been removed and in the supply position C a new winding core 26 will have been slipped into position.

Thereafter, as illustrated in FIG. 3, the practically complete film roll or coil 25 is moved further in the clockwise direction, the second applying roll 21 following this movement owing to movement of the carriage 17 to the left and it remains in engagement. Simultaneously the winding spindle 13 dwelling in the supply position C is moved, still empty, into the winding position A and the winding spindle still located in the doffing position B is moved into the supply position C and again provided with a new winding core or sleeve 26. In the position illustrated in FIG. 3, in which the film roll 25 taken from the winding position A is still being wound, the film web 10 runs over the first applying roll 20, the empty winding spindle located in this case winding position A and the second applying roll 21 to the film coil 25. In this respect the first applying roll 20 is in engagement with the empty spindle 13 in the winding position A and the second applying roll 21 is in engagement with the film coil 25, which has now reached its final diameter. It will be clearly seen that the carriages 16 and 17 have been moved independently of each other in order to adapt the applying rolls 20 and 21 to the different positions of the respective winding spindles. In this position in a known manner a beater knife 27 is caused to strike the film web 10 between the two winding spindles and severs it. Owing to the brisk movement the severed end of the film web 10 is knocked around the empty winding spindle 13 arranged in the winding position A and a new winding operation on this winding spindle commenced. The supply of the film web 10 is performed continuously during the entire operation. Then in the following part of the operation the completed film coil 25 is transferred into the doffing position B and the second applying roll 21 is moved back into its position as in FIG. 1. During the new winding operation the first applying roll 20 will be moved slowly to the right owing to displacement of its carriage 15 caused by the larger diameter of the new coil of film in order to maintain the essentially vertical position of the pivot arm 18. Finally a situation as in FIG. 1 will be reached again.

The movement of the winding spindles 13 on the guide track 12 is only diagrammatically illustrated in FIGS. 1 through 3, since this movement is not an essential part of the present invention. As regards details of this movement attention is called to the winder of the type initially mentioned or to the German patent publication 3,736,395 A, which indicates by way of example that the different winding spindle 13 are provided with drive motors for rotation thereof. For instance the winding spindle 13 in the winding position A illustrated in FIG. 3 is firstly run up to its speed corresponding to the winding speed before it is brought into contact with the first applying roll 20. The applying rolls 20 and 21 may also be provided with suitable drive motors in order to run them up to the desired speed of rotation, for instance the second applying roll 21 before it makes contact with the film roll 25 illustrated in FIG. 2.

Figure 4:
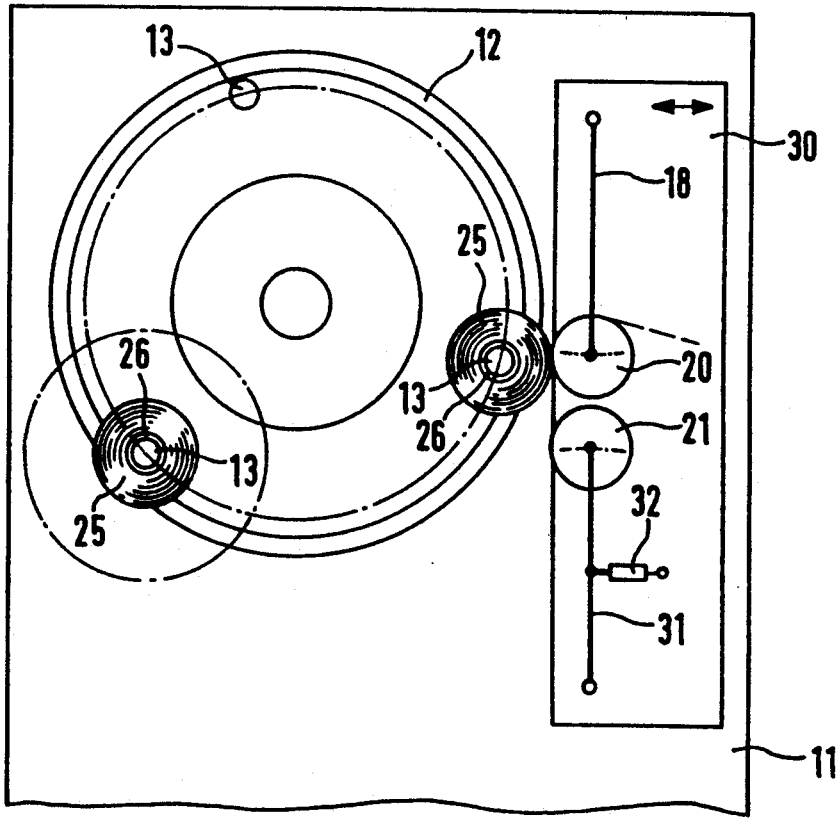
FIG. 4 shows a circular winder as a second embodiment of the invention with a horizontally moving holding part for both of the applying rolls in the working position in accordance with FIG. 1.
Figure 5:
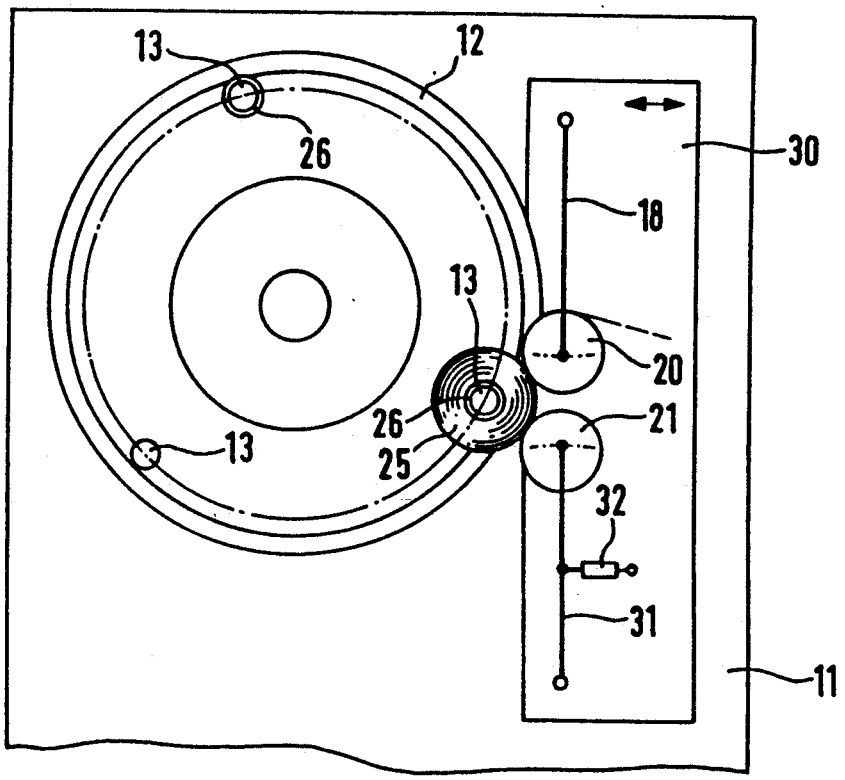
FIG. 5 shows the second embodiment of the invention as illustrated in FIG. 4 in a working position in accordance with FIG. 2.
Figure 6:
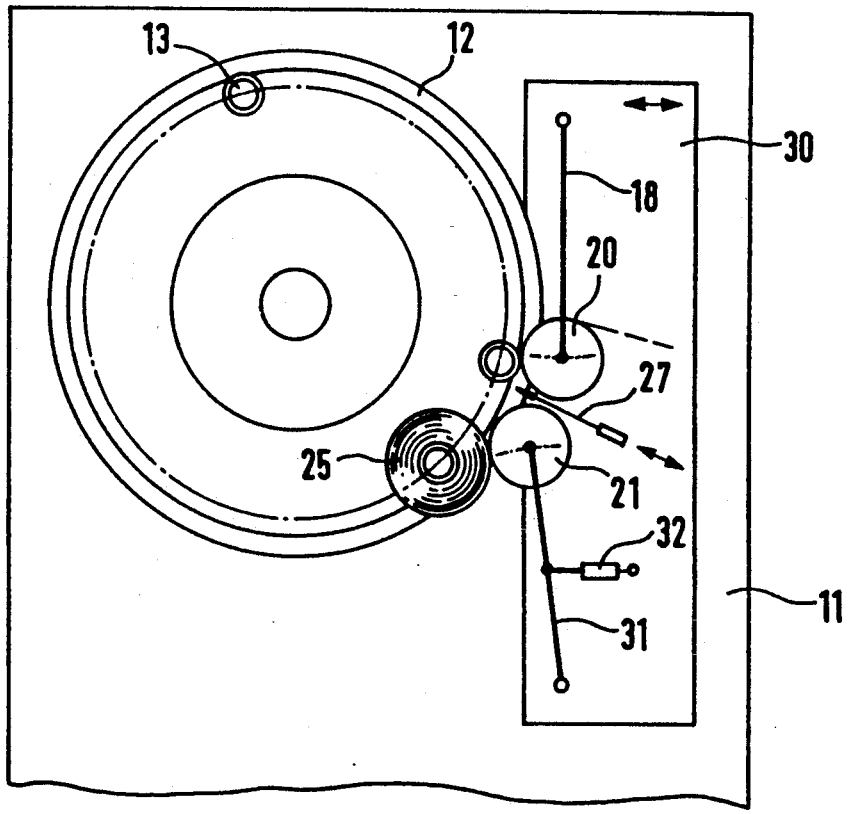
FIG. 6 shows the second embodiment of the invention illustrated in FIGS. 4 and 5 in a working position in accordance with FIG. 3.

The second embodiment of the invention illustrated in FIGS. 4 through 6 has as single horizontally moving carriage 30, which takes the place of the two carriages 16 and 17 able to be moved independently of each other and having the two applying rolls 20 and 21 mounted pivotally on it. The first applying roll 20 is again suspended by the pivot arm 18 while the second applying roll 21 is arranged atop a pivot arm 31. This pivot arm 31 may be moved by an actuator 32, for instance a pneumatic or electric motor driven actuator, out of its vertical position and back into the same. Furthermore like parts included in the first embodiment of the invention are denoted by like reference characters and are not described again. The working positions illustrated in FIGS. 4 through 6 correspond to the ones illustrated in FIGS. 1 through 3. During the movement of the nearly completed film coil 25 out of the winding position A as in FIGS. 4 and 5 the pivot arms 18 and 31 remain in a substantially vertical position, the carriage 30 moving to the left. It is only on the further movement of the nearly completed film coil 25 as in FIG. 6 that the second applying roll 21 has to be pivoted back to the left so that the first applying roll 20 may remain its mass-neutralized position. After this the second applying roll 21 is moved back into its mass-neutral position and the entire carriage 30 is moved slowly to the right in accordance with the increase in the diameter of the coil on the winding spindle 13 now in the position A. In all operations the first applying roll 20 is able to remain in its mass-neutral position, in which the pivot arm 18 assumes a substantially vertical setting. It is only the lower, standing pivot arm 30 which has to be moved out of its vertical setting during the operation illustrated in FIG. 6. This is however only a very brief operation during removal of the completed film coil as far as severing the film web 10 so that this brief movement out of the mass-neutral position may be tolerated. But on the other hand there is the advantage of the simpler construction owing to having only a single carriage. In the case of this embodiment of the invention as well it is possible for the pressing force of the applying rolls 20 and 21 again to be set by a small angular movement of the pivot arms 18 and 31, or for that matter by adjustment of the actuating member 32 or a further actuating member, not illustrated, for the upper pivot arm 18 or by means of spring members acting on the pivot arms 18 and 31 or the pivot joints.

Further designs and arrangements of the pivot arms for the applying rolls 20 and 21 are made possible by a combination of elements of the two illustrated embodiments of the invention. Thus for instance it is possible in the case of the second embodiment of the invention for the two pivot arms 18 and 31 to be suspended or hanging from a common carriage 30 or in the case of the first embodiment of the invention it is possible for the pivot arm 19 for the second applying roll 21 also to be atop a separate carriage. Furthermore it is possible in principle to preferentially use the suspended or hanging arrangement, but in an individual case both pivot arms may be upwardly extending ones.

Figure 7:
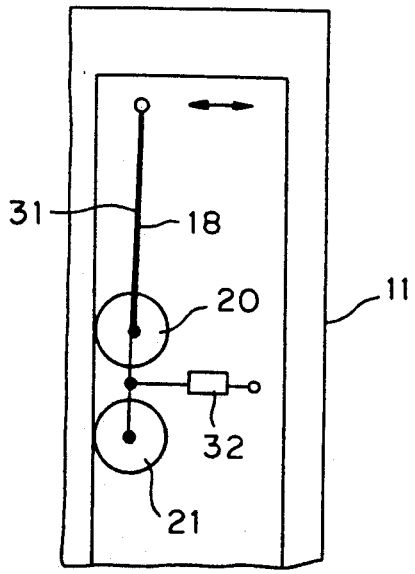
FIG. 7 is a partial diagrammatic side elevation of a further embodiment.

As a modification of the second embodiment of the invention in accordance with FIGS. 4 through 6 it is possible as well for both pivot arms 18 and 31 to hang for pivoting around a common pivot axis as shown in FIG. 7.

The two embodiments of the invention are related to use in a circular winder. However it is possible for the arrangement in accordance with the invention of the applying rolls 20 and 21 to be utilized in a cascade winder or another design of a winder, in the case of which the winding spindles are moved along a guide track.

Furthermore it is naturally possible for the reverse direction or rotation counterclockwise to be preferred. The functions described will then be performed as if they were seen in a mirror.

I claim:

1. An apparatus for winding web-like or strip-like material, comprising rotatably mounted and motor driven winding spindles, which are individually able to be moved along and located along a guide track, one respective full winding spindle being moved out of a winding position along the track after the winding operation and an empty winding spindle then being moved into the winding position substantially simultaneously and for changing the winding spindles in the winding position with a continuous supply of the material a first applying roll is brought into engagement on the wound material on the empty winding spindle located in the winding position and a second applying roll is moved into engagement with the wound material on the full winding spindle moving out of the winding position, the applying rolls being mounted on essentially vertical pivot arms, wherein ends of the pivot arms remote from the applying rolls are arranged pivotally on at least one horizontally movable holding part and a control device is provided for adjustment of the essentially vertical setting of the pivot arms by horizontal sliding of the at least one holding part.

2. The apparatus as claimed in claim 1, wherein at least one of the two applying rolls is suspended from the at least one holding part.

3. The apparatus as claimed in claim 1, wherein the pivot arms of the two applying rolls are arranged on two holding parts which are able to be moved horizontally independently of each other.

4. The apparatus as claimed in claim 1, wherein the pivot arms of the two applying rolls are jointly arranged on a single horizontal movable holding part.

5. The apparatus as claimed in claim 4, wherein the pivot axes of said pivot arms are adapted to be swung about a common pivot axis.

6. The apparatus as claimed in claim 4, wherein the control device is adapted primarily for adjustment of the vertical position of the pivot arm of the first applying roll.

7. The apparatus as claimed in claim 1, comprising actuating members, adjustment of the pressing force of the individual applying rolls, on the associated pivot arm.

8. The apparatus as claimed in claim 1, comprising a knock off device for the material to be wound and arranged to be moved between the applying rolls.

9. The apparatus as claimed in claim 1, in which the at least one holding part is in the form of at least one carriage.

10. The apparatus as claimed in claim 1 in the form of a circular winder.

11. The apparatus as claimed in claim 1, wherein said control means controls the engagement of the second applying roll on the wound material prior to disengagement of the first applying roll when the full winding spindle is moved on.

12. The apparatus as claimed in claim 1, wherein said control device is an automatic control device.

13. The apparatus as claimed in claim 7, wherein said actuating members comprise spring means for adjustment of the pressing force of the individual applying rolls.

* * * * *